US009796460B1

(12) United States Patent
Hawk

(10) Patent No.: US 9,796,460 B1
(45) Date of Patent: Oct. 24, 2017

(54) PONTOON CLEANING ASSEMBLY

(71) Applicant: Gordon Hawk, Sligo, PA (US)

(72) Inventor: Gordon Hawk, Sligo, PA (US)

( * ) Notice: Subject to any disclaimer, the term of this patent is extended or adjusted under 35 U.S.C. 154(b) by 0 days.

(21) Appl. No.: 15/191,689

(22) Filed: Jun. 24, 2016

(51) Int. Cl.

| | |
|---|---|
| ***B63B 59/00*** | (2006.01) |
| ***B63B 59/08*** | (2006.01) |
| ***B08B 1/00*** | (2006.01) |
| ***A46B 9/02*** | (2006.01) |
| ***A46B 5/02*** | (2006.01) |
| ***B25G 1/04*** | (2006.01) |
| ***B25G 1/10*** | (2006.01) |
| ***B63B 35/34*** | (2006.01) |

(52) U.S. Cl.
CPC ..... *B63B 59/08* (2013.01); *A46B 5/02* (2013.01); *A46B 9/02* (2013.01); *B08B 1/002* (2013.01); *B25G 1/04* (2013.01); *B25G 1/102* (2013.01); *B63B 35/34* (2013.01)

(58) Field of Classification Search
CPC ..... B63B 59/00; B63B 59/06; B63B 59/08; B63B 2059/00; B63B 2059/06; B63B 2059/08; B63B 2059/082; B63B 2059/087; B63B 35/34; B08B 1/002; B25G 1/04; B25G 1/102; A46B 5/02; A46B 9/02
USPC ..... 114/221 R, 222
See application file for complete search history.

(56) References Cited

U.S. PATENT DOCUMENTS

| | | | | |
|---|---|---|---|---|
| 3,227,124 | A | 1/1966 | Campbell | |
| 3,561,391 | A | 2/1971 | Locati | |
| 4,102,290 | A * | 7/1978 | Weiss | B63B 59/08 114/222 |
| 4,991,533 | A | 2/1991 | Sterling | |
| 5,105,752 | A * | 4/1992 | Pompei | B63B 59/08 114/222 |
| D331,151 | S | 11/1992 | Kiefer | |
| 5,209,176 | A | 5/1993 | Pompei et al. | |
| 5,685,251 | A * | 11/1997 | Halko | B08B 1/00 114/222 |
| 6,263,821 | B1 * | 7/2001 | Hodder | A46B 17/02 114/222 |
| 9,527,559 | B2 * | 12/2016 | Ford | B63B 59/06 |
| 2014/0216321 | A1 | 8/2014 | Ford | |

* cited by examiner

*Primary Examiner* — Daniel V Venne

(57) ABSTRACT

A pontoon cleaning assembly for cleaning floats on a pontoon boat includes a handle that may be manipulated. A scrubbing unit is movably coupled to the handle. The scrubbing unit may scrub a float on a pontoon boat while the pontoon boat is floating.

9 Claims, 4 Drawing Sheets

PONTOON CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cleaning devices and more particularly pertains to a new cleaning device for cleaning floats on a pontoon boat.

BRIEF SUMMARY OF THE INVENTION

An embodiment of the disclosure meets the needs presented above by generally comprising a handle that may be manipulated. A scrubbing unit is movably coupled to the handle. The scrubbing unit may scrub a float on a pontoon boat while the pontoon boat is floating.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
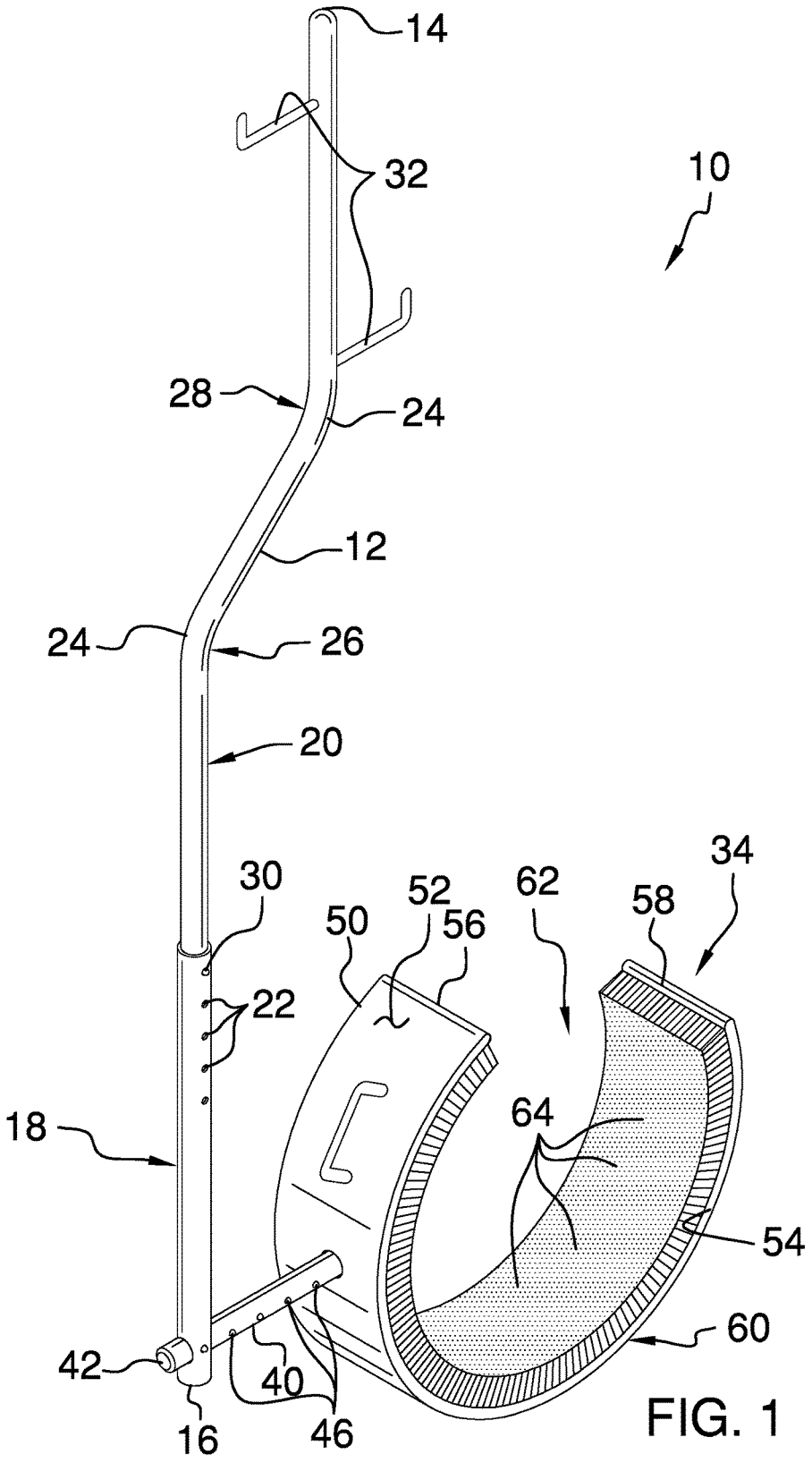
FIG. 1 is a perspective view of a pontoon cleaning assembly according to an embodiment of the disclosure.
Figure 2:
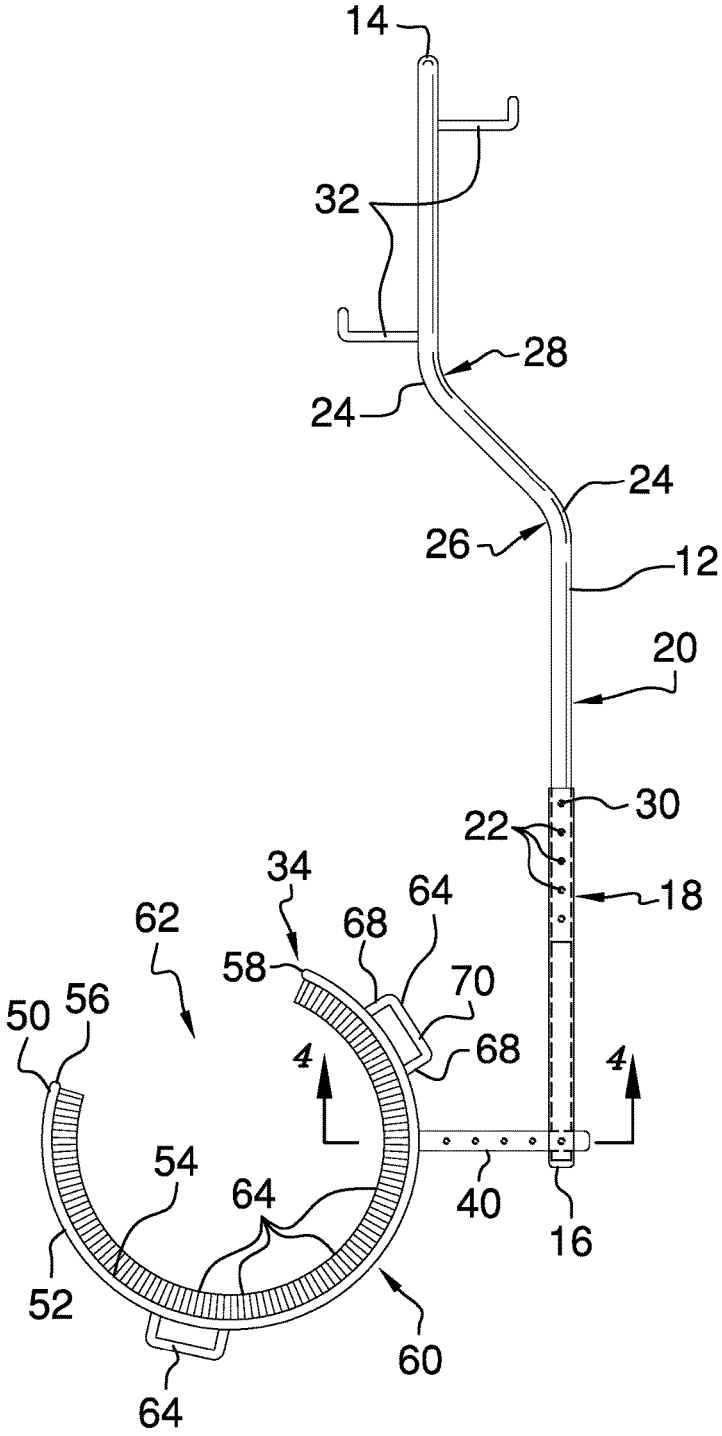
FIG. 2 is a front view of an embodiment of the disclosure.
Figure 3:
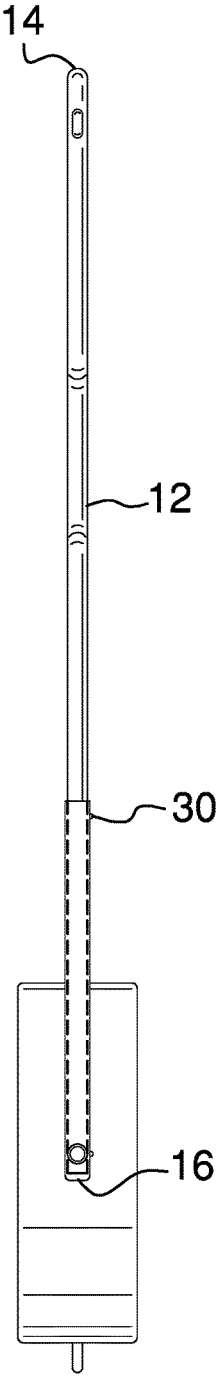
FIG. 3 is a right side view of an embodiment of the disclosure.
Figure 4:
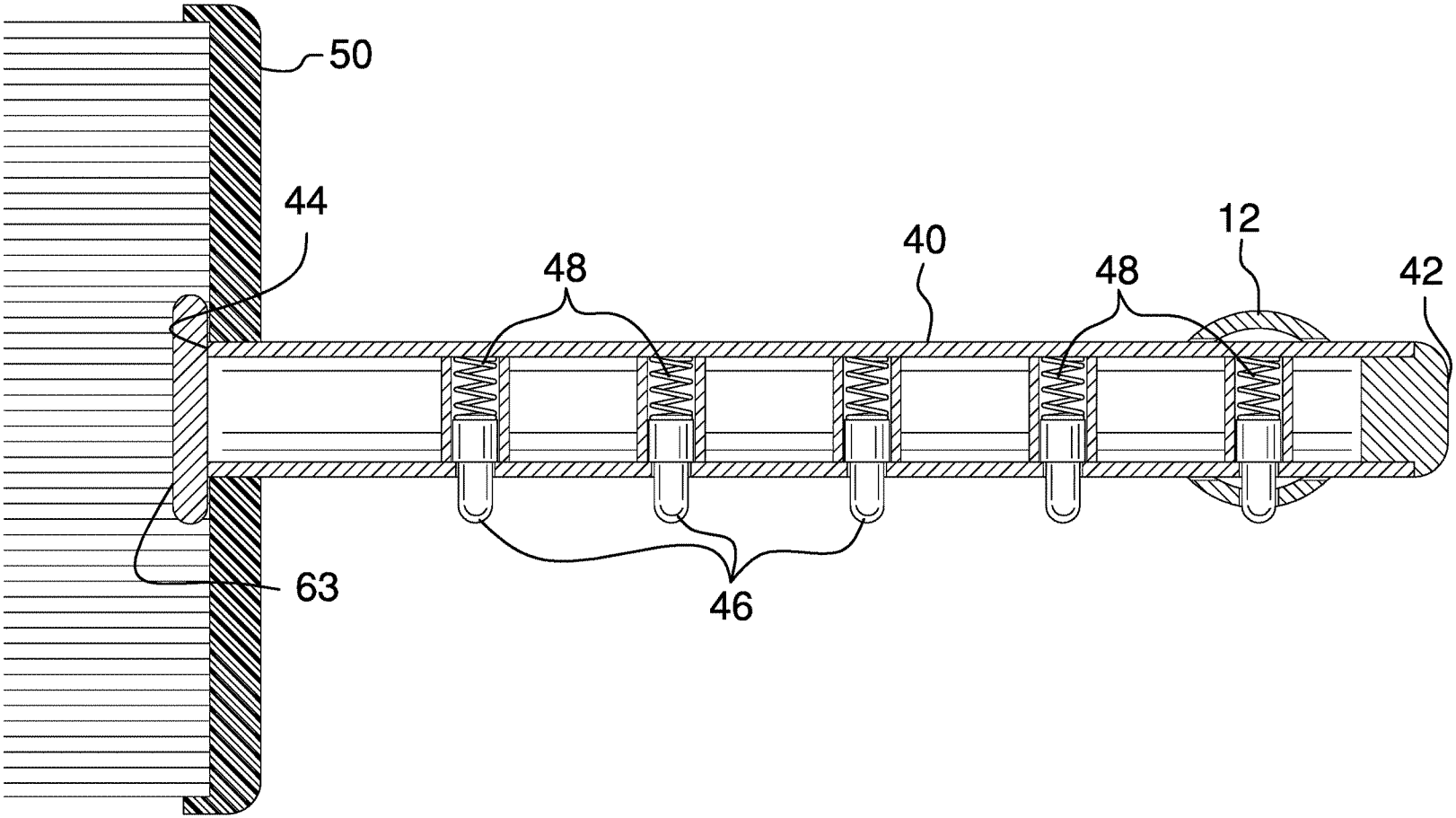
FIG. 4 is a cross sectional view taken along line 4-4 of FIG. 2 of an embodiment of the disclosure.
Figure 5:
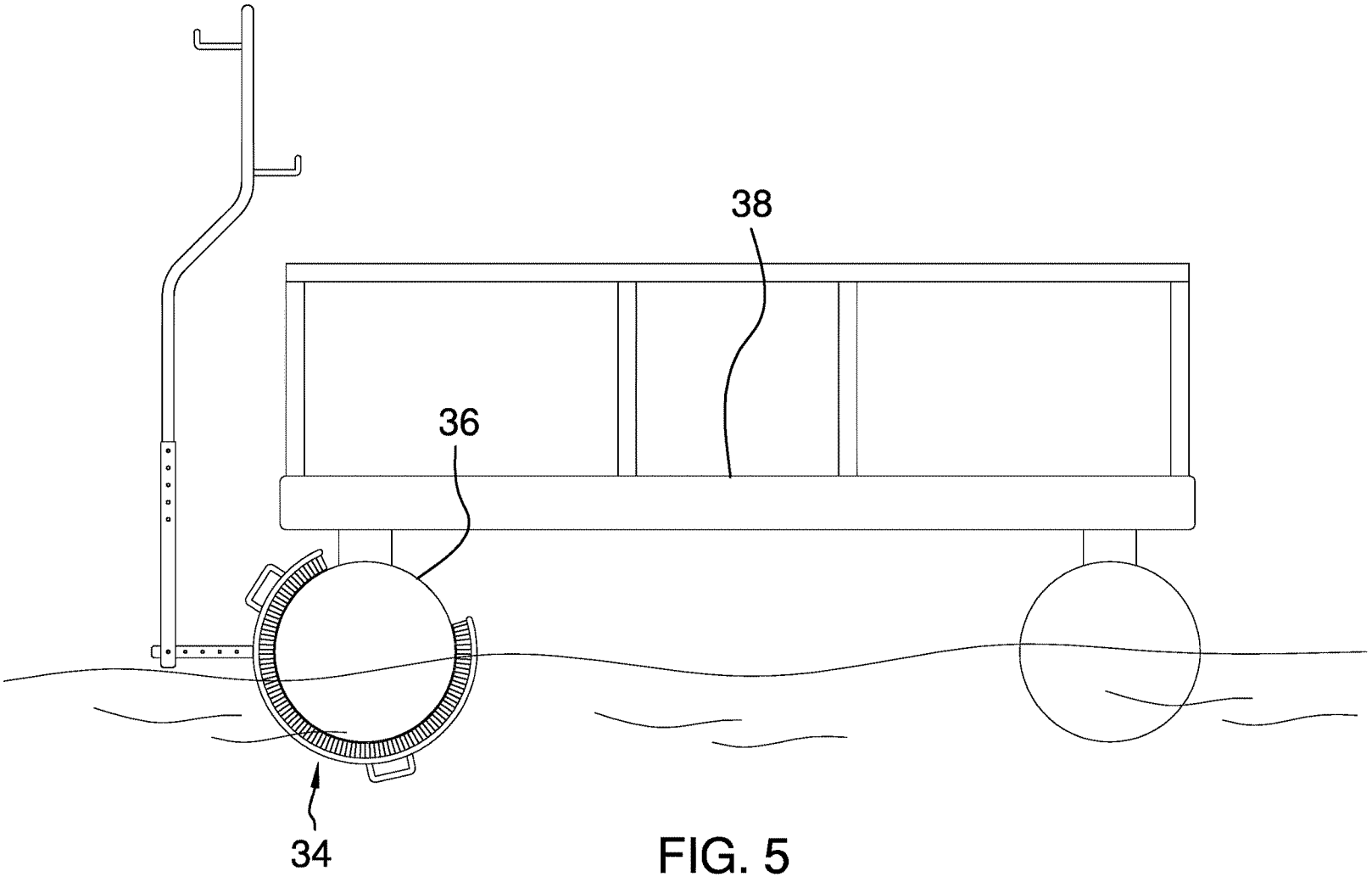
FIG. 5 is a perspective in-use view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the pontoon cleaning assembly 10 generally comprises a handle 12 that may be manipulated. The handle 12 has a first end 14 and a second end 16. The handle 12 has a lower portion 18 that is slidably coupled to an upper portion 20. Thus, the handle 12 has a telescopically adjustable length. The lower portion 18 has a plurality of apertures 22 extending therethrough. The apertures 22 are spaced apart from each other and are distributed on the lower portion 18.

The upper portion 20 has a pair of bends 24 thereon to define a first angle 26 and a second angle 28. The first angle 26 is congruent with the second angle 28. A lock 30 is movably coupled to the upper portion 20 and the lock 30 may be manipulated. The lock 30 engages a selected one of the apertures 22 in the lower portion 18. Thus, the handle 12 is retained at a selected length.

A pair of first grips 32 is provided. Each of the first grips 32 is coupled to and extends away from the upper portion 20. Each of the first grips 32 is oppositionally positioned on the upper portion 20. Each of the first grips 32 may be comprised of a resiliently compressible material such as rubber or the like. Each of the first grips 32 is staggered along the upper portion 20.

A scrubbing unit 34 is provided. The scrubbing unit 34 is movably coupled to the handle 12. The scrubbing unit 34 may scrub a float 36 on a pontoon boat 38 while the pontoon boat 38 is floating. The pontoon boat 38 may be a pontoon boat 38 of having cylindrical floats.

The scrubbing unit 34 comprises a rod 40 that has a primary end 42 and a secondary end 44. The rod 40 extends through the lower portion 18 of the handle 12. The rod 40 is substantially aligned with the second end 16 of the handle 12. A plurality of pins 46 is provided and each of the pins 46 is movably positioned within the rod 40. Each of the pins 46 extends outwardly from the rod 40. The pins 46 are spaced apart from each other and are distributed along the rod 40.

A plurality of biasing members 48 is provided. Each of the biasing members 48 is positioned within the rod 40. Each of the biasing members 48 is aligned with an associated one of the pins 46. Thus, each of the biasing members 48 biases each of the pins 46 outwardly from the rod 40. A selected one of the pins 46 engages the lower portion 18 of the handle 12 such that the rod 40 extends a selected distance away from the handle 12.

A saddle 50 is provided. The saddle 50 has an outer surface 52, an inner surface 54, a first end 56 and a second end 58. The secondary end 44 of the rod 40 extends through the saddle 50. The saddle 50 is curved such that the first end 56 is directed toward the second end 58. Thus, the saddle 50 forms an open loop 60 thereby facilitating the saddle 50 to be positioned around the float 36.

An opening 62 in the loop 60 is directed toward the first end 14 of the handle 12. The saddle 50 may be comprised of a resiliently flexible material. Thus, the first end 14 and the second end 16 of the saddle 50 may be urged apart from each other to position the saddle 50 around the float 36. A stop 63 is coupled to the secondary end 44 of the rod 40. The stop 63 abuts the inner surface 54 of the saddle 50 thereby inhibiting the rod 40 from being removed from the saddle 50.

A plurality of bristles 64 is provided and each of the bristles 64 is coupled to the inner surface 54 of the saddle 50. Each of the bristles 64 may frictionally engage the float 36 when the saddle 50 is positioned around the float 36. Thus, the bristles 64 may clean the float 36. The bristles 64 are spaced apart from each other and are distributed along the saddle 50. The bristles 64 remove debris from the float 36 thereby reducing hydrodynamic resistance of the float 36.

A pair of second grips 66 is provided. Each of the second grips 66 has a pair of end members 68 and a central member 70 extending between the end members 68. Each of the end members 68 corresponding to the second grips 66 is coupled to the outer surface 52 of the saddle 50. Thus, the central member 70 corresponding to each of the second grips 66 may be gripped.

In use, a user stands on a deck of the pontoon boat 38. The handle 12 is manipulated to position the saddle 50 around one of the float 36s. The handle 12 is manipulated to urge the saddle 50 along a length of the float 36. Thus, the bristles 64 clean the float 36. The user may enter the water and grip each of the second grips 66 to position the saddle 50 around the float 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pontoon cleaning assembly being configured to clean floats on a pontoon boat, said pontoon cleaning assembly comprising:

a handle being configured to be manipulated, said handle having a first end and a second end, said handle having a lower portion being slidably coupled to an upper portion such that said handle has a telescopically adjustable length, said lower portion having a plurality of apertures extending therethrough, said apertures being spaced apart from each other and distributed on said lower portion, said upper portion having a pair of bends thereon to define a first angle and a second angle, said first angle being congruent with said second angle; and a scrubbing unit being movably coupled to said handle wherein said scrubbing unit is configured to scrub a float on a pontoon boat while the pontoon boat is floating, said scrubbing unit comprising a rod having a primary end and a secondary end, said rod extending through said lower portion of said handle, said rod being substantially aligned with said second end of said handle.

2. The pontoon cleaning assembly according to claim 1, further comprising a lock being movably coupled to said upper portion wherein said lock is configured to be manipulated, said lock engaging a selected one of said apertures in said lower portion such that said handle is retained at a selected length.

3. The pontoon cleaning assembly according to claim 1, further comprising a pair of first grips, each of said first grips being coupled to and extending away from said upper portion, each of said first grips being oppositionally positioned on said upper portion.

4. The pontoon cleaning assembly according to claim 1, further comprising a plurality of pins, each of said pins being movably positioned within said rod, each of said pins extending outwardly from said rod, said pins being spaced apart from each other and distributed along said rod.

5. The pontoon cleaning assembly according to claim 4, further comprising a plurality of biasing members, each of said biasing members being positioned within said rod, each of said biasing members being aligned with an associated one of said pins such that said biasing members biases each of said pins outwardly from said rod, a selected one of said pins engaging said lower portion of said handle such that said rod extends a selected distance away from said handle.

6. The pontoon cleaning assembly according to claim 5, further comprising a saddle having an outer surface, an inner surface, a first end and second end, said saddle being curved such that said first end is directed toward said second end to form an open loop wherein said saddle is configured to be positioned around the float, said outer surface being coupled to said secondary end of said rod, and opening in loop being directed toward said first end of said handle, said outer surface being coupled to said secondary end of said rod.

7. The pontoon cleaning assembly according to claim 6, further comprising a plurality of bristles, each of said bristles being coupled to said inner surface of said saddle wherein each of said bristles is configured to frictionally engage the float when said saddle is positioned around the float thereby facilitating said bristles to clean the float, said bristles being spaced apart from each other and being distributed along said saddle.

8. The pontoon cleaning assembly according to claim 6, further comprising a pair of second grips, each of said second grips having a pair of end members and a central member extending between said end members, each of said end members corresponding to said second grips being coupled to said outer surface of said saddle wherein said central member corresponding to each of said second grips is configured to be gripped.

9. A pontoon cleaning assembly being configured to clean floats on a pontoon boat, said pontoon cleaning assembly comprising:

a handle being configured to be manipulated, said handle having a first end and a second end, said handle having a lower portion being slidably coupled to an upper portion such that said handle has a telescopically adjustable length, said lower portion having a plurality of apertures extending therethrough, said apertures being spaced apart from each other and distributed on said lower portion, said upper portion having a pair of bends thereon to define a first angle and a second angle, said first angle being congruent with said second angle;

a lock being movably coupled to said upper portion wherein said lock is configured to be manipulated, said lock engaging a selected one of said apertures in said lower portion such that said handle is retained at a selected length;

a pair of first grips, each of said first grips being coupled to and extending away from said upper portion, each of said first grips being oppositionally positioned on said upper portion;

a scrubbing unit being movably coupled to said handle wherein said scrubbing unit is configured to scrub a float on a pontoon boat while the pontoon boat is floating, said scrubbing unit comprising:

a rod having a primary end and a secondary end, said rod extending through said lower portion of said handle, said rod being substantially aligned with said second end of said handle, a plurality of pins, each of said pins being movably positioned within said rod, each of said pins extending outwardly from said rod, said pins being spaced apart from each other and distributed along said rod, a plurality of biasing members, each of said biasing members being positioned within said rod, each of said biasing members being aligned with an associated one of said pins such that said biasing members biases each of said pins outwardly from said rod, a selected one of said pins engaging said lower portion of said handle such that said rod extends a selected distance away from said handle, a saddle having an outer surface, an inner surface, a first end and second end, said saddle being curved such that said first end is directed toward said second end to form an open loop wherein said saddle is configured to be positioned around the float, and opening in loop being directed toward said first end of said handle, said outer surface being coupled to said secondary end of said rod, a plurality of bristles, each of said bristles being coupled to said inner surface of said saddle wherein each of said bristles is configured to frictionally engage the float when said saddle is positioned around the float thereby facilitating said bristles to clean the float, said bristles being spaced apart from each other and being distributed along said saddle, and a pair of second grips, each of said second grips having a pair of end members and a central member extending between said end members, each of said end members corresponding to said second grips being coupled to said outer surface of said saddle wherein said central member corresponding to each of said second grips is configured to be gripped.

* * * * *